US007631460B2

(12) United States Patent
Napier

(10) Patent No.: US 7,631,460 B2
(45) Date of Patent: Dec. 15, 2009

(54) TRANSPORTABLE BUILDING

(75) Inventor: Donald Stewart Napier, Victoria (AU)

(73) Assignee: Prebuilt Pty Ltd's, Kilsyth (AU)

( * ) Notice: Subject to any disclaimer, the term of this patent is extended or adjusted under 35 U.S.C. 154(b) by 496 days.

(21) Appl. No.: 10/515,790

(22) PCT Filed: May 29, 2003

(86) PCT No.: PCT/AU03/00658

§ 371 (c)(1),
(2), (4) Date: Mar. 13, 2006

(87) PCT Pub. No.: WO03/100182

PCT Pub. Date: Dec. 4, 2003

(65) Prior Publication Data

US 2006/0225369 A1 Oct. 12, 2006

(30) Foreign Application Priority Data

May 29, 2002 (AU) ..... PS 2648
Sep. 24, 2002 (AU) ..... 2002951693

(51) Int. Cl.
*E04B 1/346* (2006.01)
*E04B 1/00* (2006.01)
*E04H 1/00* (2006.01)
*E05D 15/00* (2006.01)

(52) U.S. Cl. ..... 52/69; 52/66; 52/64; 52/79.1; 52/79.5; 52/270; 16/368

(58) Field of Classification Search ..... 52/66, 52/64, 79.1, 268, 269, 270, 284, 309.11, 52/69; 16/368
See application file for complete search history.

(56) References Cited

U.S. PATENT DOCUMENTS

| | | | | |
|---|---|---|---|---|
| 2,052,757 | A * | 9/1936 | Fitch | 52/69 |
| 3,653,165 | A * | 4/1972 | West | 52/67 |
| 4,660,332 | A * | 4/1987 | Colvin, Jr. | 52/79.5 |
| 5,237,784 | A * | 8/1993 | Ros | 52/79.5 |
| 5,327,698 | A * | 7/1994 | Uhl | 52/68 |
| 5,765,316 | A * | 6/1998 | Kavarsky | 52/67 |
| 6,035,583 | A | 3/2000 | Papke | |
| 6,070,367 | A * | 6/2000 | Wagner et al. | 52/7 |
| 2003/0056446 | A1 * | 3/2003 | Napier | 52/66 |

FOREIGN PATENT DOCUMENTS

AU 200032575 A1 11/2000

(Continued)

*Primary Examiner*—Brian E Glessner
*Assistant Examiner*—Omar Hijaz
(74) *Attorney, Agent, or Firm*—Wolf, Greenfield & Sacks, P.C.

(57) ABSTRACT

A transportable building system including at least partially erecting a building, transporting the at least partially erected building (6) on its side to a building location, locating the at least partially erected building on a support at the building location, and orientating the at least partially erected building so that it is correctly orientated relative to its support. Further disclosed is a transportable building, including a first structural component (51; 58), a second structural component (40; 56) and a hinge (68) coupling the first and second structural components whereby the second structural component is pivotable between a folded position and an unfolded erected position of the building. The hinge is reconfigurable to allow the second structural component to be relatively displaced away from the first structural component in the unfolded erected position of the second structural component.

16 Claims, 9 Drawing Sheets

FOREIGN PATENT DOCUMENTS

| | | | |
|---|---|---|---|
| CA | 1 204 911 | | 5/1986 |
| DE | 26 55 677 | A1 | 8/1976 |
| DE | 3412245 | A1 | 4/1984 |
| EP | 0 280 265 | A1 | 2/1988 |
| ES | 8702973 | A1 | 7/1985 |
| FR | 2 312 610 | | 5/1975 |
| RU | 2 032 034 | C1 | 3/1995 |
| WO | WO 83/02791 | A1 | 2/1983 |

* cited by examiner

TRANSPORTABLE BUILDING

FIELD OF THE INVENTION

The present invention relates to transportable buildings and in particular to manufactured or pre-built housing.

BACKGROUND ART

It is known to pre-construct housing or commercial building units at a base yard and subsequently transport them, either whole or in two or more modules, to a client's allotment. Such buildings are typically referred to as manufactured or pre-built housing and for reference purposes will subsequently be referred to as manufactured housing.

A principal constraint in the design of manufactured housing is the strict dimensional limit set by road transport authorities for ordinary unescorted loads. For example, while it is possible to transport new manufactured homes in Australia having a width of 5 m, and a maximum height of 4.8 m, this typically requires expensive permits, escorts and set routes, and regulations confine travel times to daylight hours. In Australia and most countries, permits, escorts and/or set routes, and restrictions on time of travel, can be avoided only if the width load dimension is limited to 2.5 m and the height load dimension is limited to 4.8 m, less the height of a truck tray, which is normally 1.0 m.

If the manufactured housing is required to be transported overseas, it must comply with International Shipping Organisation (ISO) width dimensional limitations, which are more restrictive than the above referenced domestic limitations. Thus, in Australia, manufactured housing is such that the buildings or modules either require over-dimensional permits and escorts, or are severely restricted in their design and size by the width dimensional limits. Export housing, if attempted, is restricted by the ISO dimensional limitations.

Aside from the issue of additional cost, access of over-dimensional buildings to building sites is more restricted. For example, over-dimensional buildings are typically not suitable for dual occupancy sites, provision of granny flats or house extensions, if the permanent location of the over-dimensional building is not easily accessible due to access width restrictions. Further, over-dimensional buildings are not generally suitable for individual on-site housing, holiday housing, permanent housing such as country, coastal and suburban retirement villages or mining town accommodation.

Whether manufactured housing is designed beyond or within the transport dimensional limits, a variety of design approaches and features have been proposed to enhance the subsequent erected building while minimising its dimensions during transit.

For example, Australian patent application 16482/95, Australian patent 539799 and UK patent application 2257170 disclose manufactured housing with hinged or extendible roof, verandah or alcove elements. Australian patent application 71019/87 discloses a demountable building assembly which is adaptable to form one or more transportable containers. Building panels are stored in the containers. U.S. Pat. No. 4,635,412 discloses an assembly which folds to shipping container dimensions and includes multiple hinged panels to form, for example, an enlarged floor area. Extension floor panels hinge down on each side of the assembly and frame assemblies in turn hinge up from the outer edges of the extension floor panels. U.S. Pat. No. 5,237,784 discloses a transportable container which has the form of a shipping container and includes foldable walls which are designed to form an enlarged floor and ceiling. Australian patent 720059 discloses an arrangement in which a core of the house is transportable as a shipping container.

There is also manufactured housing that utilises shipping containers. U.S. Pat. No. 4,891,919 discloses a shipping container having hinge-down extension floor panels and hinge-up outer side walls that are designed to unfold to form a house. International patent publication WO 93/20297 discloses a shipping container that forms a central zone of a house. Further zones are formed by hinging out extension floors and roof extensions, and hinging up outer side walls.

Housing using a standard shipping container dimension of 2.1 m ceiling height cannot be approved due to building regulation requirements for a minimum or average ceiling height of 2.4 m in all habitable rooms other than wet areas.

Transportable housing is also provided in the form of kit housing. Like manufactured housing, some kit housing utilises shipping containers, while other kit housing utilises purpose-built structures which typically have the dimensions of shipping containers. U.S. Pat. No. 5,447,000 discloses an open frame which mimics a shipping container. The open frame structure can be incorporated into a subsequent house or dismantled to provide building components for the subsequent house.

While kit housing is usually cheaper to purchase, considerable time and greater effort and expertise is typically required to erect a house using kit housing compared with manufactured housing. Every component must be coded, often in several languages, in an elaborate kit manual adding to the complexity and difficulty of construction relative to manufactured housing. Manufactured housing is therefore more suitable for locations where building expenses are high, services such as power or accommodation are non-existent, or building expertise is limited. Furthermore, while warranties to protect the purchaser are required by law in Australia and other countries such as USA, United Kingdom and Canada for standard and manufactured housing, they are not possible for kit housing, leaving the buyer with no comeback or guarantee. A guarantee is required by lending authorities, and therefore kit housing is difficult to fund with loan money.

It is an object of the invention to provide improved manufactured housing that is of optimum dimensions during transport but enhanced size and form on erection. It is also preferable that erection be achievable easily and quickly.

SUMMARY OF THE INVENTION

In a first aspect, the present invention provides a transportable building system comprising:

at least partially erecting a building;

transporting the at least partially erected building on its side to a building location;

locating the at least partially erected building on a support at the building location; and orientating the at least partially erected building so that it is correctly orientated relative to its support.

In its first aspect, the invention further provides a transportable building which is at least partially erected and in this condition arranged for transportation to a building location on its side, and for re-orientation at the building location so that it is correctly oriented relative to a support at the building location.

It is emphasised that, in other aspects of the invention later described, the transportable building is not necessarily transported on its side.

The transported at least partially erected building preferably forms a box structure about an enclosed space, more preferably free of protrusions or extensions.

The step of orientating the at least partially erected building so that it is correctly orientated relative to its support can be carried out before, after or simultaneously with the step of locating the at least partially erected building on the support at the building location.

Preferably, the at least partially erected building is, while transported on its side, within dimensional limits for unescorted transport at any time of day or night.

In a preferred arrangement, the invention takes advantage of the requirement that the minimum ceiling height within a building (eg. 2.1 m in Australia for wet areas) is slightly less than the standard international maximum width for road transport, 2.5 m. Thus, with the partially erected building transported on its side, the difference between these two standards can accommodate two floor panels and two roof panels of total combined thickness no greater than 400 mm (ie. average maximum per panel of 100 mm), leaving a potential wet area height in excess of 21. m.

Once the transportable building is at the building location it is required to be positioned on a support and, if necessary, attached thereto. A partially erected transportable building is then unfolded becoming fully erected. Completing erection can involve unfolding components of the transportable building and/or attachment of building components which may be transported within the transported erected portion of the building. Unfolding of the transportable building preferably involves pivoting of hinged pre-constructed portions of the building, which may be panels and may take the form of floor, wall and/or roof portions, from a folded position to an unfolded, erected position.

These pivot mountings may in some instances be hinge arrangements that allow relative displacement of the floor, wall or roof portions in the unfolded position. This displacement may be for widening the building in its erected state, or to enhance the compactness of the transported erected portion of the building. The floor, wall and roof portions may be panels which respectively form part of a floor, wall and roof. Suitably, the panels are arranged to unfold into locating relationship with adjacent panels or other building components for attachment thereto to complete floors, walls and roofs of the fully erected building. Some of the panels, eg. roof panels in particular, may not be hinged and these unhinged panels are preferably transported separately within or on top of the transported erected portion of the building, for extraction and installation during subsequent full erection of the building. Some of the hinged panels may also be transported separately within the building for subsequent hinged attachment to pre-erected panels of the erected portion of the transportable building.

In a second aspect, the invention provides a transportable building, including:

a first structural component;

a second structural component; and hinge means coupling said first and second structural component whereby the second component is pivotable between a folded position and an unfolded erected position of said building wherein said hinge means is reconfigurable to allow said second component to be relatively displaced away from said first component in said unfolded erected position of the second component.

In this second aspect, the first and second structural components may typically respectively be a floor component of the at least partially erected building, and an extension floor component.

The building may include a panel which is positionable (eg. by being hingedly mounted) in the erected building as a verandah roof. This panel is conveniently nestable within an opening in a panel that serves as a wall in the. erected structure.

In a third aspect of the invention, there is provided a method of erecting a building from a transported folded condition having a plurality of wall components and a first roof component supported thereby, including:

folding out a wall component;

repositioning a second roof component so that it is at least in part supported by said folded-out wall component, and lies with an edge opposed to an edge of the first components;

jointly raising said edges of said roof components to a position defining a roof-line ridge; and fixing said roof components at said position defining a roof-line ridge.

By this method, it is possible to achieve a ceiling height at the roof-line ridge up to 2 meters, allowing a mezzanine floor thereunder to provide a habitable space.

Advantageously, in its third aspect, the invention includes coupling said roof components by a plurality of link means that space said roof components and serve as hinges during said raising step.

Suitably, the at least partially erected building is substantially fully erected, so that once the transportable building is located and orientated at the building location, the hinged or other panels simply have to be appropriately positioned to fully erect it.

The transportable building is preferably substantially wired prior to transportation. The electrical wiring is preferably located within one or more panel cavities and enclosed therein by removable cover plates. Wiring can then be completed in the process of fully erecting the transportable building. The process of locating, orientating and fully erecting (including completing wiring) a typical 2 bedroom house which includes a mezzanine floor should take two workmen less than one day to complete.

The transportable building may include structure that serves as a mezzanine floor in the erected building. Advantageously, this mezzanine floor is selectively set back from a wall in one or more rooms and wall means, eg. a pivotably mounted wall portion, is positionable to be upstanding from the set back edge to define a partial cathedral ceiling. By this means, in the case where the transported erected portion of the building is to be within the aforementioned 2.5 m width limit, an average ceiling height for the room greater than 2.1 m can be achieved while maintaining 2.1 m under the mezzanine floor. A mezzanine height at the roof-line ridge of 2 m can also be achieved, as discussed -earlier.

In a further aspect, the invention provides a transportable building, including:

a plurality of wall components and roof means supported thereby, wherein said roof means includes:

a first roof component that is supported by said wall components during transport as an outer roof component, and is displaceable at a building location to provide a roof component for a folded-out part of the building, and a second roof component supported by said wall components relative to said first roof component to define a storage space during transport and a rooftop zone on said displacement of the first roof component.

The building components may comprise structural members or elements. Suitably, the panels incorporate structural members of the building such as walls or roof sections premade in panel form. The structural members may comprise bearers, joists, studs, rafters or other beams. Alternatively, structural members are transported within the transportation container and incorporated into the fully erected building at the building location. Structural elements other than those incorporated into the panels are preferably transported within the transported erected portion of the building and may include items such as bolts, nails, screws, hold down straps, structural or other timber or steel components which may be required in addition to the hinged or other panels, to fully erect the building, and items such as windows, sliding doors, kitchen cupboards, structural extensions, and ridge or barge capping.

The transportable building may comprise any known building components or techniques. For example, the floor of the transportable building is preferably constructed using lightweight steel or timber bearers and joists which, when appropriately interconnected, provide joist flooring surfaces which lie in substantially the same plane as adjacent surfaces of the bearers. Such a bearer/joist arrangement reduces the overall height of the building thereby increasing the height of rooms of the transportable building. Examples of suitable such bearer/joist arrangements include steel c-beam bearers, and corresponding steel or timber joists, ends of these joists being arranged to fit into internal channels of the c-beams. An alternative construction utilises frames of welded or otherwise joined square hollow-section steel beams.

Fixtures of the erected portion of the building may be transported in their desired location. Alternatively, they are contained within the transported partially erected building and moved to their desired location for fixture thereto during the process of fully erecting the building. Any necessary plumbing is preferably installed, perhaps totally, as part of the process of building the partially erected building.

While the partially erected building can initially be orientated relative to its support so that it is correctly orientated, rather than being on its side as it was during transportation, it is preferred that it is initially orientated relative to its support in the same manner as it was during transportation. A floor portion of the transportable building, which preferably forms a base of the transportation container, may then be hingedly attached to its support. The transportable building can then be unfolded from this sideways orientation by pivoting the erected portion relative to the supported floor portion until the erected portion is also supported via its support.

The at least partially erected building preferably provides a storage space in its lower region. The storage space is preferably positioned adjacent the floor portion and is preferably suitable for storing at least some of the building components which are transported therein but do not form part of the erected portion of the transportable building. The storage space is preferably accessed by opening a hinged roof panel, facilitating removal of long or large panels, or fittings such as cabinets, windows, doors, and ridge or barge capping.

The transportable building may be arranged for attachment to another transportable building to form a building which is a combination of two or more transportable buildings. Alternatively, the transportable building may be arranged to attach to a permanent building to extend it.

The transportable building preferably comprises lifting means to be engaged by a crane for moving it onto and off the transportation vehicle, and if necessary, for manoeuvring it to the correct orientation or upright position in the process of fully erecting the building. The lifting means may comprise lugs or forklift pockets or projecting attachment brackets. In remote areas, where it is difficult to use or obtain cranes, it is possible to manoeuvre the partially erected building over the stumps and lower the building with jacks. A lightweight truck crane can then lift or lower the roof, wall and floor panels into position.

The transportable building may be, for example, a transportable house or other dwelling, shelter, commercial building, or shed.

Suitably, the transported partially erected building has dimensions, eg. width dimensions, of an international standard cargo shipping container and includes a load-bearing frame and floor, walls and roof panels. The transported partially erected building may have the cast steel corner fittings, or similar, typical of an international standard cargo shipping it which the container can be stacked on other similar containers for shipping or storage.

By international standard cargo shipping container is meant a container that meets International Shipping Organisation (ISO) requirements for the International Convention for Safe Containers (CSC) and the American Bureau of Shipping (ABS). These standards include requirements for the size and strength of containers; suitable sizes for the present purpose would be those referred to as 20 ft and 40 ft containers.

For additional structural stability the fully erected building may be fastened down to concrete pads or footings, including where desired, fastenings such as, for example, cyclonic tie-down rods, to additionally anchor the lower corner fittings to the pads or footings.

BRIEF DESCRIPTION OF THE DRAWINGS

The invention will now be further described, by way of example only, with reference to the accompanying drawings, in which.

EMBODIMENTS OF THE INVENTION

Figure 1:
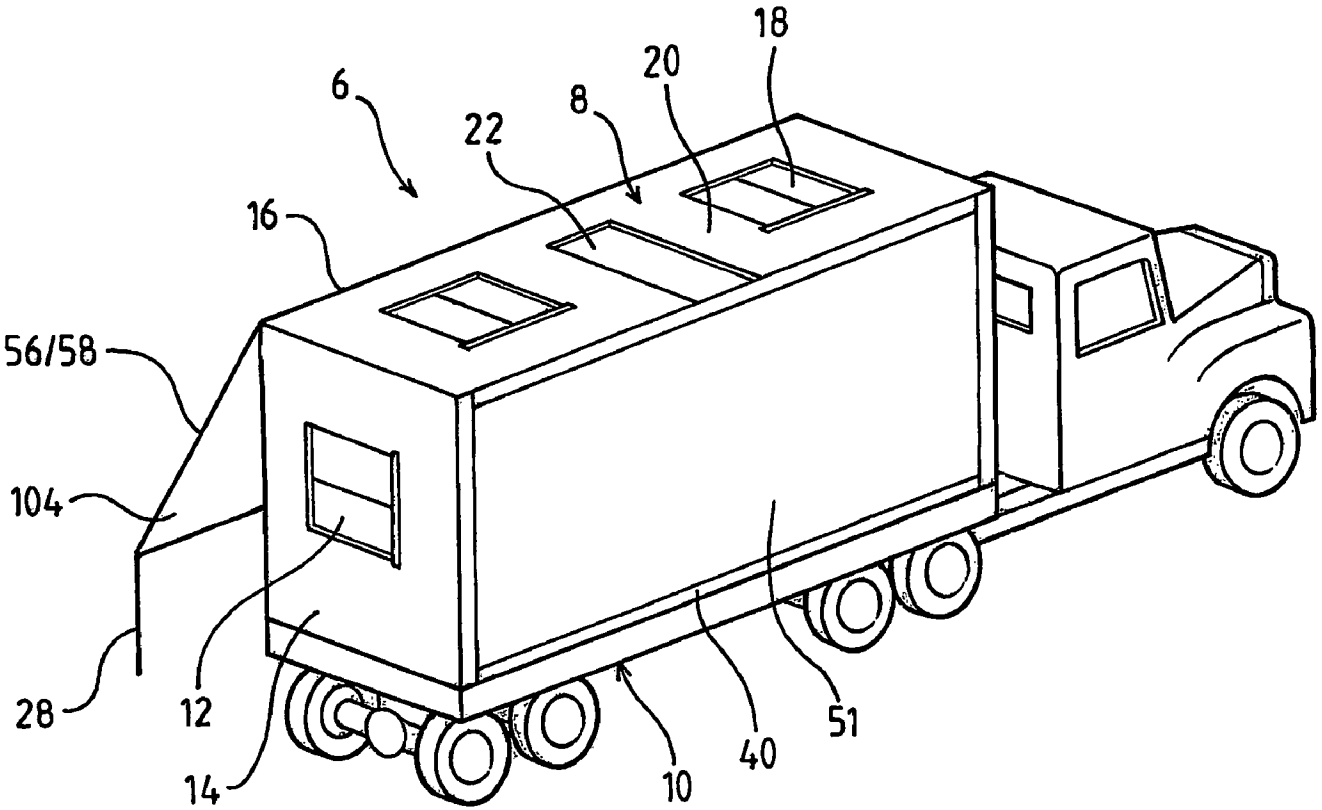
FIG. 1 is a perspective view of a transportable house according to an embodiment of the invention, positioned on a trailer for transport to a building location.
Figure 2:
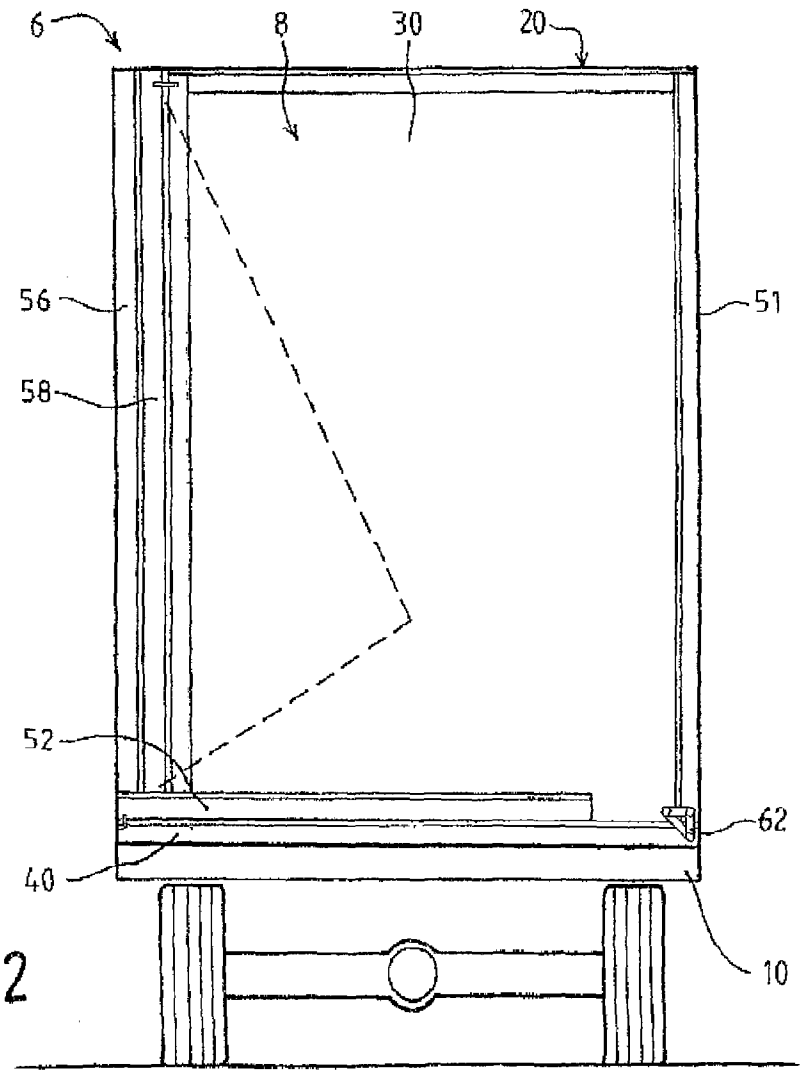
FIG. 2 is a cross-sectional view of the transportable house in the on-trailer position of FIG. 1.

Referring to FIGS. 1 and 2, the transportable house 6, in its folded configuration on its side on a trailer 10, generally comprises an erected generally rectangular unit having the appearance and form of a box structure 8 about an enclosed space. A window 12 is formed in end walls 14 of the transportable house 6 and windows 16 and 18 are formed in sidewall 20. A door 22 is positioned approximately midway along the length of the sidewall 20. The transportable house 6 therefore comprises a pre-erected or pre-assembled unit comprising the end walls 14 and an external side wall 20. As will be explained in greater detail below, it also comprises floor panels 40, 51, roof panels 56 and 58, an external side wall 52, and an internal wall panel 54 (see FIG. 4) which is positioned opposite the side wall 20.

Although the roof panels 56/58 are shown in a partially open position in FIG. 1 for removal of materials from inside the transportable house 6, they are closed during transport so that they lie in a vertical plane. The floor panel 51 also lies in a vertical plane, while side walls 20, 52 and internal wall panel 54 lie in a horizontal plane. The pre-erected portion of the transportable house 6 is therefore positioned on trailer 10 on its side so that the floor panel 51, roof panels 56/58, side walls 20, 52 and internal wall panel 54, as positioned on the trailer 10, lie in planes perpendicular to planes they would normally lie in.

The pre-erected box structure of the transportable house 6 is approximately 2.5 m high and approximately 3.6 m wide. This is how the structure is prepared at the manufacturer's factory site: it is then re-orientated by crane and placed on its side on trailer 10 for transport to the purchaser's erecting site. This means that in its sideways orientation, as positioned on a trailer 10, it is 3.6 m above the supporting surface of the trailer 10 and 2.5 m wide. These measurements are within Australian and international road transport dimensional limits for unescorted transport at any time of day or night, ie. they are within the dimensional limits if permits, escorts, set routes and travel time confined to daylight hours are to be avoided. House 6 in the form of pre-erection box structure 8 is thereby readily transportable from a factory site on a truck trailer 10. It is built at such a site in its correctly oriented position and then orientated onto its side onto trailer 10.

If it is preferred to avoid re-orientation, and the aforementioned restrictions are acceptable, the box structure can be transported in its "right side up" condition, with the floor 51 on the trailer.

The pre-erected portion and hinged or other panel support structures of the transportable house are formed of welded galvanised steel frames. However, as would be readily apparent to a person skilled in the relevant art, they could also be formed of corresponding timber structural members, or a combination of steel and timber structural members. Likewise, the panels themselves can be formed of steel or timber, or a combination thereof. The panels could also comprise panels typically known as sandwich type panels.

Other features of the transportable house 6 will be described in the course of describing erection of the transportable house 6 which essentially involves unfolding of hinged roofs, floor and wall panels of the transportable house 6, and attachment of other panels, structural members and elements that are contained within the transportable house 6.

On arrival at the building location or erection site and before the transportable house 6 is craned or forklifted off the trailer 10, roof panels 56 and 58 may be pivoted upwardly via hinges 24 and 26 and propped in an open position by suitable posts 28 (FIG. 1). With the roof panels 56 and 58 in this open position, building components, such as ridge capping 59, which are required to fully erect the transportable house 6, can be easily removed from the inside 30 of the pre-erected box structure of transportable house 6.

Figure 3:
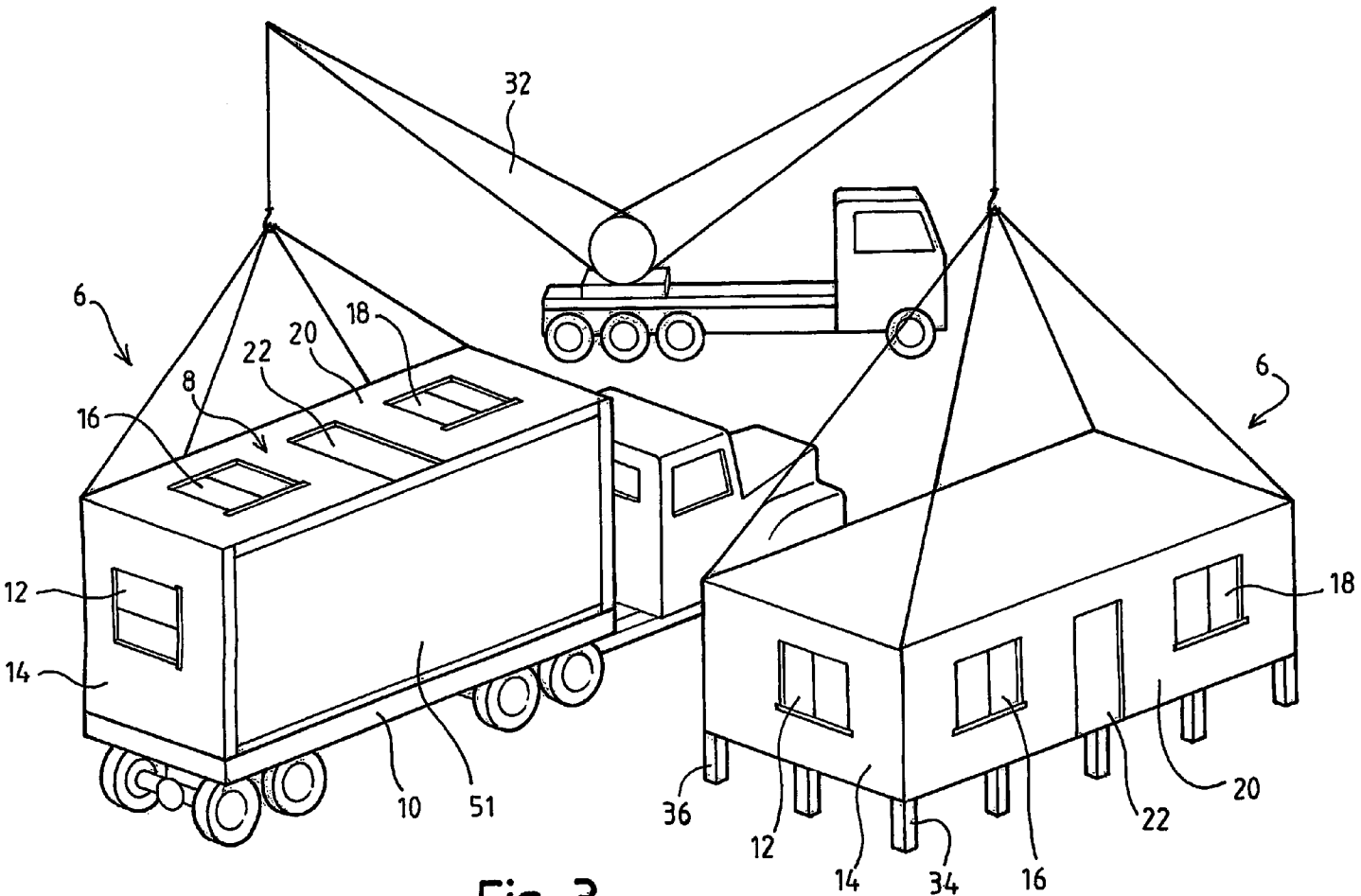
FIG. 3 is a composite view of the transportable house shown of FIG. 1 being lifted off the trailer by a crane, reoriented and placed in foundation stumps in its final position.

Once all of the removable building components have been removed from the transportable house 6, a crane 32 is used to lift the- transportable house 6 from the trailer 10 (FIGS. 2 and 3). As shown in FIG. 4A the transportable house 6 can be lifted from the trailer 10 and placed on three rows of stumps 36, 37 and 38 (located in pre-drilled concreted holes 39) so that a floor panel 51 is positioned on the stumps 36, 37 and 38. The floor panel 40 is then subsequently pivoted downwardly to be supported by stumps 34, to increase the floor area provided by floor panel 51 by approximately 60%.

In an alternative delivery sequence, the transportable house 6 is lifted by the crane 32 and placed on the row of stumps 34 and 36 so that it is supported by them on its side and orientated the same way as it was on the trailer 10. The floor 40 is left in place and the rest of the structure is pivoted onto stumps 37, 38.

With the transportable house 6 supported on the stumps, it is typically secured to those stumps by hold down straps (not shown). One end of the straps is secured, via a bolt, to floor panel 51 and the other ends of the straps are similarly attached, via bolts, to the stumps.

Figure 4C:
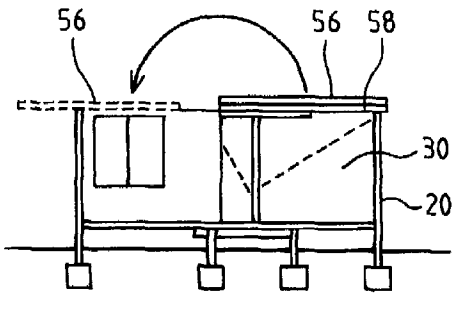
FIG. 4 is a sequence of diagrams A to E showing the principal steps in opening up the house, supported on stumps, to its enlarged condition.
Figure 4B:
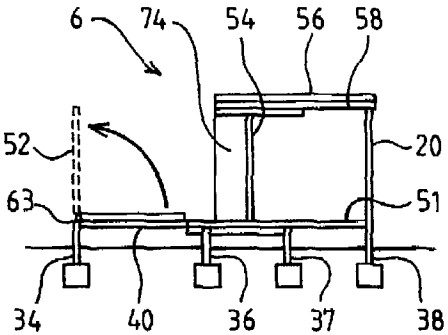
Figure 4A:
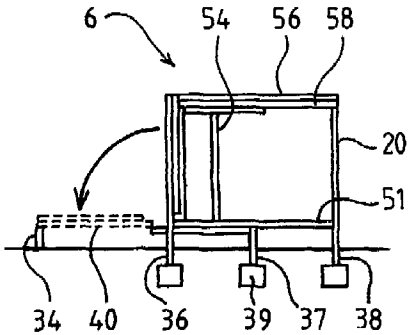
Figure 4E:
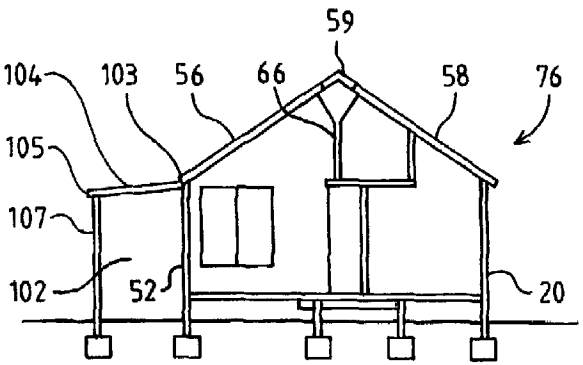
Figure 4D:
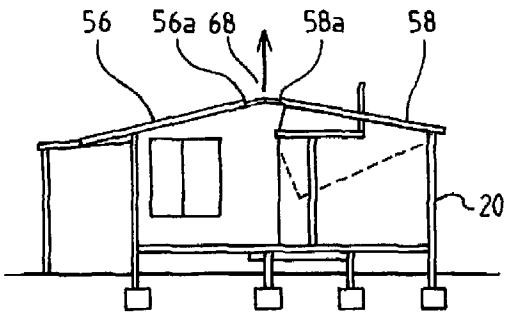
Figure 7:
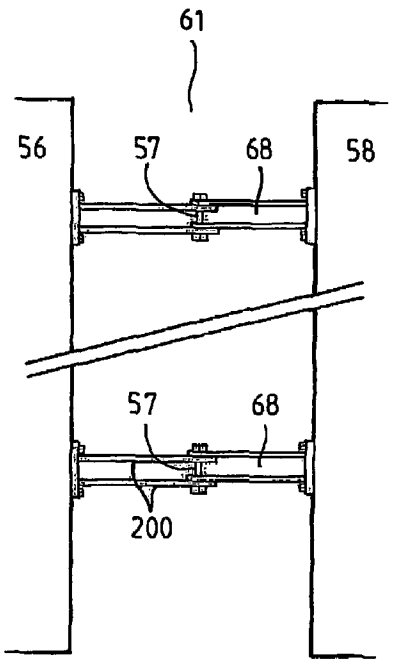
FIGS. 6 and 7 are a vertical cross-sectional view and a plan view respectively of the hinging arrangement that couples the two main roof panels.
Figure 6:
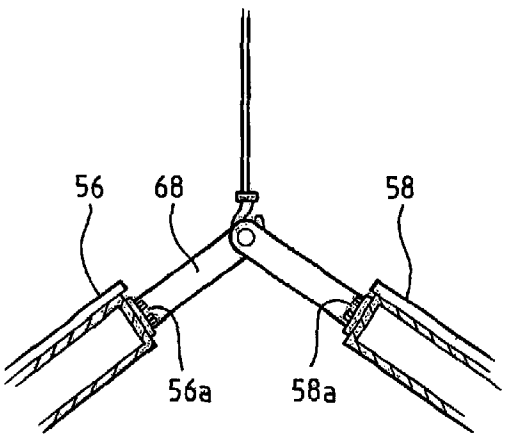

Referring to FIG. 4B, with the transportable house 6 partially unfolded so that floors panels 40 and 51 are supported by stumps 34-38, the partially unfolded transportable house 6 comprises external side walls 20 and 52, a pair of end walls (not shown), an internal wall 54 and two roof panels 56 and 58. External sidewall 52 is pivoted upwardly (FIG. 4B) from a position in which it rests on floor panel 40, via hinges 62, which are positioned along an outer longitudinal edge of floor panel 40. A roof is erected by moving the outer roof panel 56 off roof panel 58 and placing it, supported, on the top of raised wall panel 52. Roof panels 56, 58 are then coupled at the centre line of the house by hinge link configurations 68 (described further below). A crane fitted to hinges 68 is employed to draw the centre edges 56*a*, 58*a* of roof panels 56, 58 upwardly to form a roofline ridge fixed by means of support beams 66 (FIGS. 4D, 5, 6 and 7). In this action, panel 56 pivots upwardly about hinge pins such as bolts 57 at its outer end, but panel 56 slides over the top of wall panel 52.

Hinge links 68 (FIGS. 6 and 7) allow lateral separation of the opposed edges 56*a*, 58*a* of panels 56, 58 in the finished structure and thereby facilitate a higher roof pitch and a wider house. The higher roof pitch may accommodate a habitable mezzanine space, which is acceptable accommodation in some types of dwellings. The resultant gap 61 can be closed by suitable ridge capping 59. Hinge links 68 comprise respective twin-plate arms 200 bolted to the opposite edges 56*a*, 58*a* (FIG. 4D) of roof panels 56,58, and hingedly coupled by hinge pin links 57: a crane hook can be fitted at this point to draw up to the roof panels.

Non-hinged panels and building members and elements which were removed from the inside 30 of the transportable house 6 are then used to complete the erected house. Referring to FIG. 4, it can be seen that the internal wall 54 is offset from a region where floors panels 40 and 51 join. This positioning of the wall 54 enables a storage space 74 (see FIG. 4) to be provided in a lower region (during transport) of the house 6 for storage of building panels, members and elements.

Figure 10:
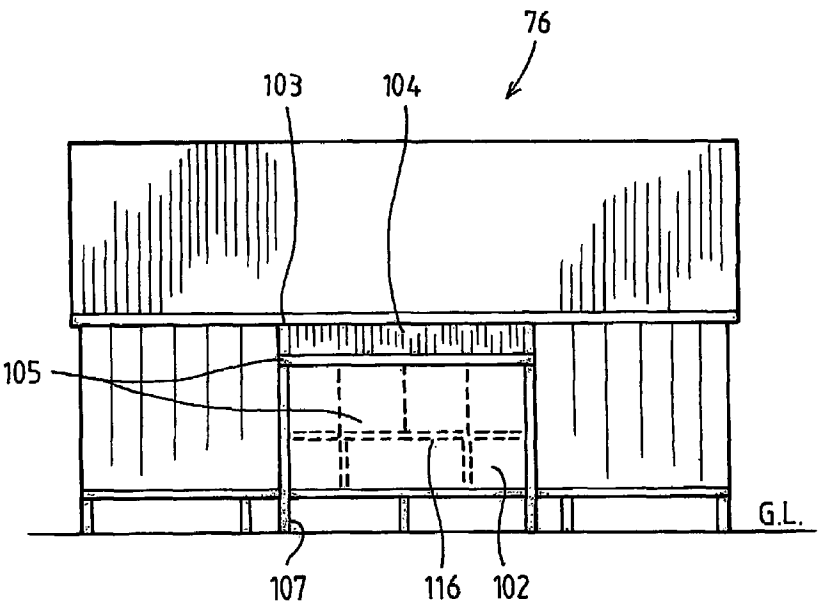
FIG. 10 is a cross-sectional view of the enlarged house, depicting the verandah and the hinged mounting of a side panel for the mezzanine floor.

The fully erected house 76 may include an optional verandah 102 formed of a roof extension 104 which is positioned approximately centrally of the length of the house 76. The roof extension 104 is supported, by its outer longitudinal edge 105, by posts 107. Roof extension 104 is hingedly supported from a top plate or top beam 103 of side wall 52 (FIG. 10) so that, on site, it can be swung up and supported on posts 107. In its transport position 104', roof extension 104 is nested in a corresponding opening 105 in wall 52 (FIG. 11) and suspended from overhead beam or top plate 103 of the wall by a sequence of hinges 101. After the roof extension is raised into position 104 on site, opening 105 is closed up by a preformed double window set 116 transported in storage space 74 (FIG. 4B). In this way, verandah roof extension 104 is fixed to the original structure without increasing the width or height of the box structure during transport (depending on the orientation of transport).

Figure 8:
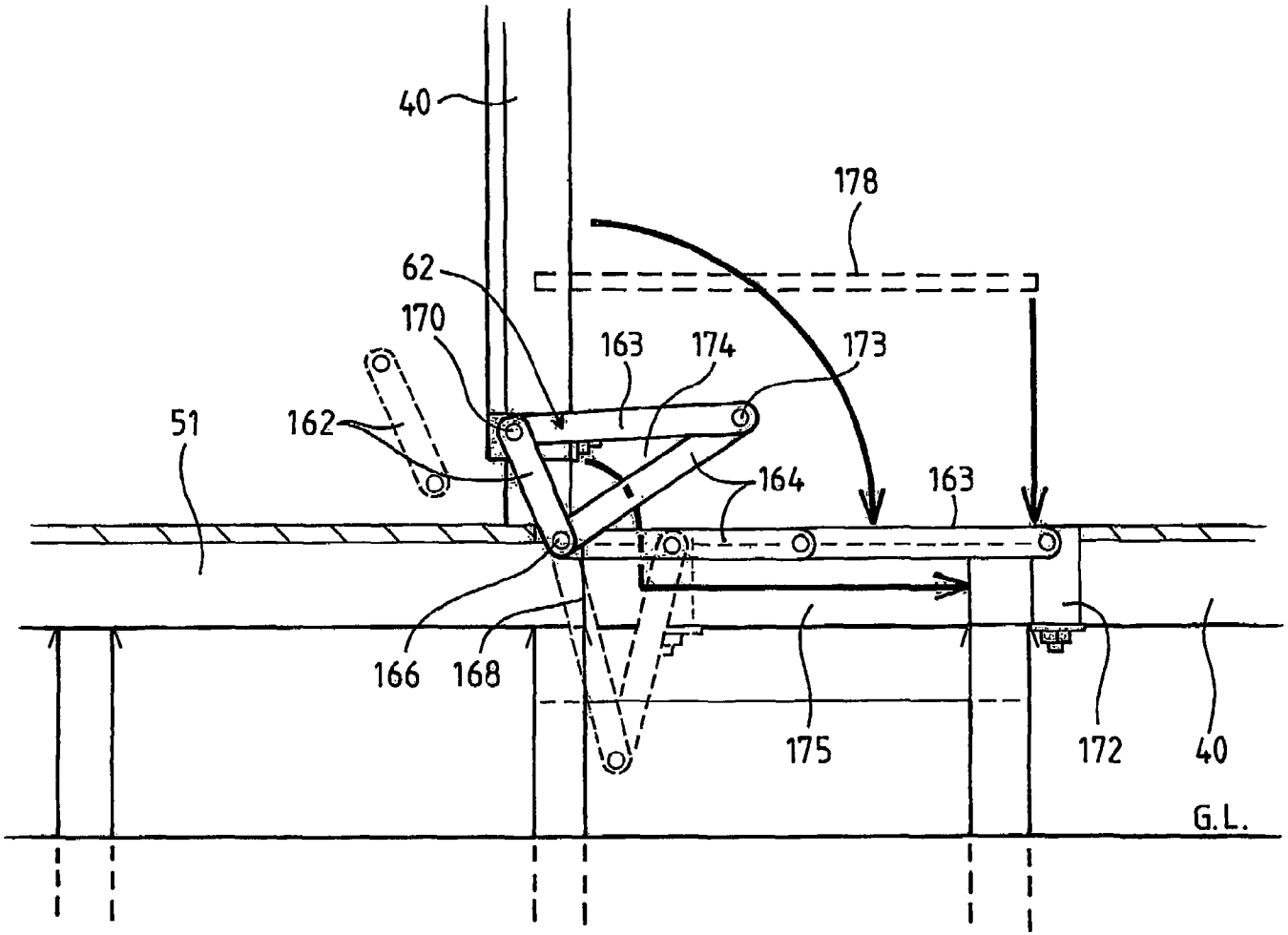
FIGS. 8 and 9 are respective front and side elevational views showing the form and movement of the hinging arrangement that supports the extension floor panel.
Figure 9:
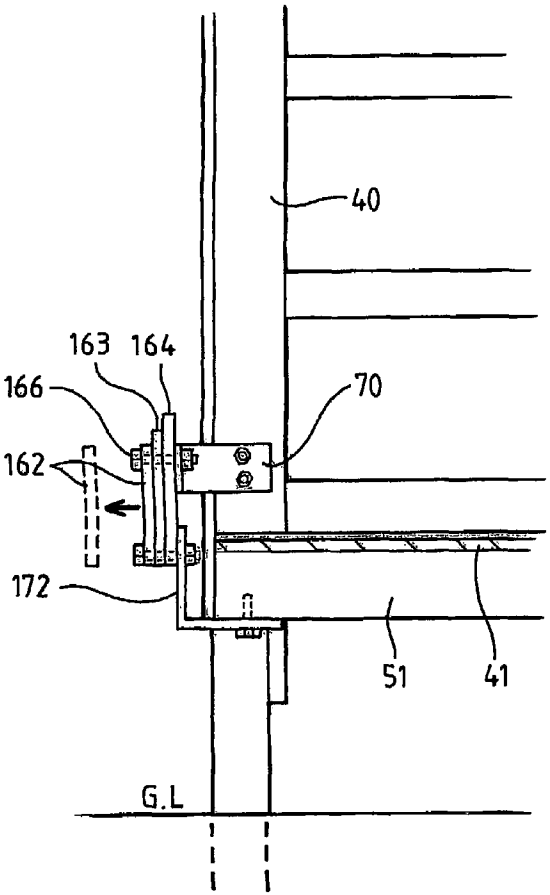

FIGS. 8 and 9 illustrate a modification of the above-described transportable house that incorporates an embodiment of the second aspect of the invention, and achieves dimensional advantages in the erected house without increasing the outer dimensions of the transported house. This modification is depicted in enlarged detail in FIGS. 8 and 9, and involves attaching floor panel 40 to floor panel 51 in a triangular displacement hinge configuration 62 so that floor panel 40 can be dropped over the edge of floor panel 51 from a position standing upright on the floor panel, and then displaced away from the floor panel. Hinge configurations 62—one at each end of the house—comprise an isosceles triangle of steel plate links 162, 163, 164 that form two couplings between hinge axis 166, adjacent the side edge 168 of floor panel 51, and a pivot mounting 170, on a right angular bracket 172 fixed to the outside main face of extension floor panel 40. The shorter base link 162 of the triangle is one of these couplings, long enough for the bottom edge face 41 of panel 40 to rest on panel 51. The other coupling consists of links 163, 164 is an initial V-connection 173 pinned together at 174.

Panel 40 pivots outwardly and downwardly about hinge axis 166 until it is flush and aligned with panel 40. Link 162 is now detached and the V-connection 173 straightened out to move panel 40 away from panel 51. The resultant gap 175, which may, for example, be 1 m or more across, is filled in by one or more floor panel inserts 178. Links 163, 164 can be wholly removed, once floor panels 40, 51 are fastened in place, so as not to interfere with the attachment of cladding to the building.

It will be appreciated that hinged links 162, 163, 164, allow lateral separation of floor 51 from panel 40 (FIGS. 8 and 9) in the finished structure and thereby, together with roof hinge 68 (FIGS. 6 and 7), facilitate the widening of the living space.

Figure 5:
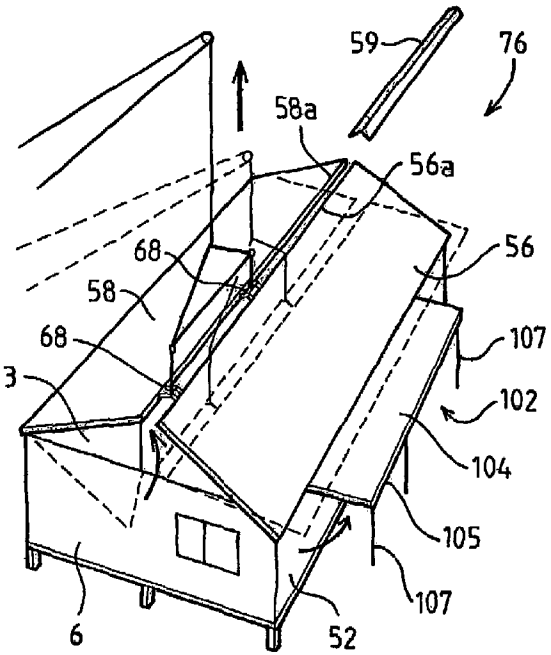
FIG. 5 is a perspective view of the enlarged house supported by stumps in its final position, between diagram D and E in FIG. 4, prior to fitting the ridge capping.
Figure 11:
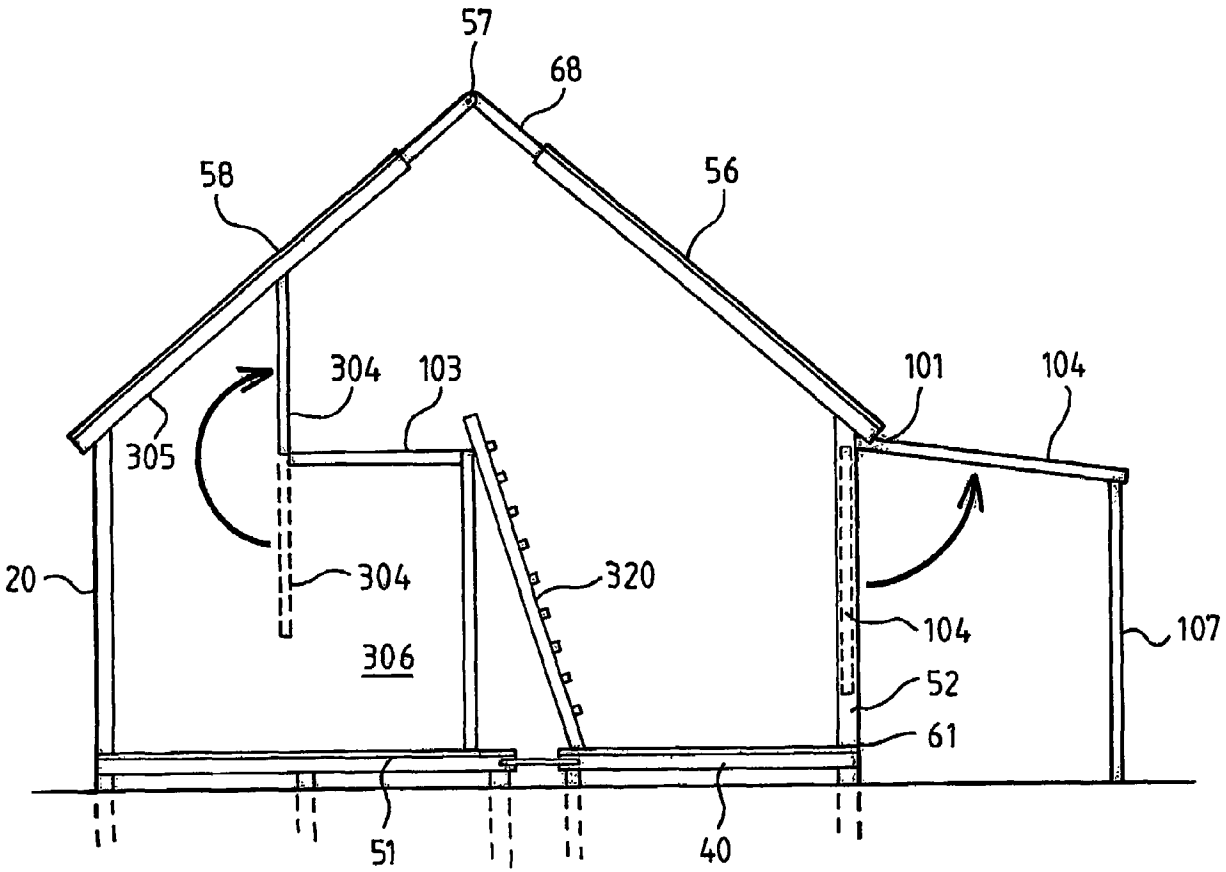
FIG. 11 is a side elevational view of the verandah arrangement, with a hinge-up roof extension.

Referring to FIGS. 5 and 11, the transportable house 6 includes a mezzanine floor 103 which is essentially identical in floor area to the floor panel 51 which is positioned directly below. The mezzanine floor 103 is accessible via a ladder (320). Mezzanine floor 103 can alternatively be formed in a wide T-shape, eg. to fully cover a centrally located bathroom but only the inner half of bedrooms to either side. A hinged panel 304 can be swung from a suspended position within each room to a raised position 304' in which it is fixed to roof panel 58. This creates a partial cathedral ceiling 305 in each bedroom (thus increasing the average ceiling height). This cathedral ceiling is facilitated by the relatively steep pitch of roof panels 56, 58.

It will be seen that, if the bathroom has a ceiling height of 2.1 m, the Australian minimum for wet areas, the total height for transport, including the combined thickness of floor panels 51, mezzanine floor 103 and roof panel 56 with ceiling height, can be kept at 2.5 m or less, the maximum transportable width, ie. the structure is within the width limit when transported on its side. Moreover, because of cathedral ceiling 305, the average ceiling height in the bedrooms such as room 306 can be 2.4 m or greater: 2.4 m is the Australian minimum for "habitable" areas. Still further, all wiring can now be completed prior to transport as lighting downlights can be installed under the mezzanine and not in the folding roof sections.

Figure 12:
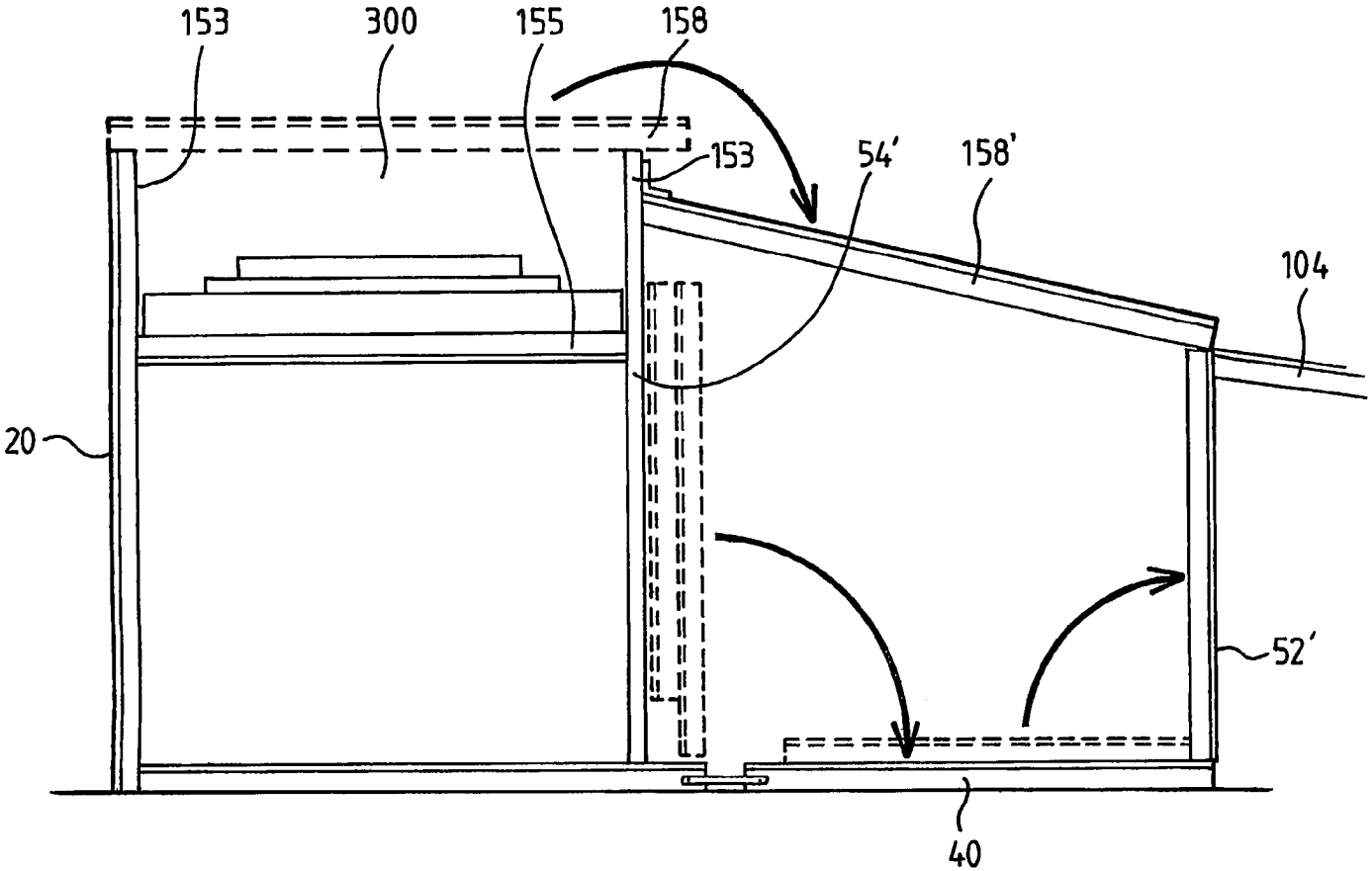
FIG. 12 is a cross-sectional view of an alternative embodiment that uses separate roof segments without a conventional gable ridge, and has a parapet at one or both ends of the house.

FIG. 12 depicts an alternative embodiment, incorporating the fourth aspect of the invention. Here, a gabled roof is not attempted but instead side wall 20' and internal wall 54' extend higher, are capped by a top panel 158 defining the box structure, and are linked interiorly by a transverse fixed panel 155 below panel 158. Floor panel 40', side wall 52', and verandah roof 104' hinge into place as with the previous embodiment. In this case, however, the roof is formed by lifting top panel 158 over the top edge of wall 54', fixing it in a sloping position at 158' to wall 54' and resting it on the top of side wall 52'.

During transport, transverse fixed panel 155 defines, between it and removable top panel 158, a storage space 300 (eg. for panels as shown) that becomes an open skillion roof-top zone in the fully erected house (sloping from rear to front in the diagram), behind a parapet 153 defined by the upper parts of side wall 20' and internal wall 54', and by end wall segments (not shown).

The invention claimed is:

1. A transportable building, including:

a first floor panel;

a second floor panel; and a hinge that couples said first and second floor panels whereby the second floor panel is pivotable between a folded position and an unfolded erected position of said transportable building to increase the floor area provided by said first floor panel;

wherein said hinge is reconfigurable to allow said second floor panel to be relatively displaced in a substantially non-rotational linear motion away from said first floor panel in said unfolded erected position of the second floor panel to form a gap therebetween adapted to be filled with one or more floor panel inserts, wherein said hinge is reconfigurable by removal of a link of said hinge that prevents relative displacement of the second floor panel away from the first floor panel.

2. The transportable building according to claim 1, having a partially erected condition in which the building forms a box structure about an enclosed space.

3. The transportable building according to claim 2, wherein said box structure has a width of less than about 2.5 meters.

4. The transportable building according to claim 2 wherein the transportable building when partially erected has an international standard cargo shipping container width dimension of about 2.5 meters and includes a load-bearing frame and floor, walls and roof panels.

5. The transportable building according to claim 1, further including folded pre-constructed components of the building adapted to be unfolded out, whereby to complete erection of the building at the building location.

6. The transportable building according to claim 5 wherein said folded pre-constructed components are panels.

7. The transportable building according to claim 5, wherein said folded pre-constructed components include a panel which is positionable in the transportable building as a verandah roof.

8. The transportable building according to claim 7 wherein said panel positionable as a verandah roof is nestable within an opening in a panel that serves as a wall in the erected structure.

9. The transportable building according claim 5, including a plurality of wall components and roof means supported thereby, wherein said roof means includes:

a first roof component that is supported by said wall components during transport as an outer roof component, and is displaceable at said building location to provide a roof for a folded-out part of the building, and a second roof component supported by said wall components relative to said first roof component to define a storage space during transport and a rooftop zone on said displacement of the first roof component at said building location.

10. A reconfigurable floor comprising:

a first floor panel;

a second floor panel; and a hinge that at least temporarily couples the first floor panel to the second floor panel, the hinge, when in a first configuration, adapted to guide the first floor panel in rotation relative to the second floor panel from a folded position to an unfolded position, rotation of the first floor panel relative to the second floor panel occurring about an axis that lies adjacent to corresponding edges of the first floor panel and the second floor panel, the hinge, when in a second configuration different tan the first configuration, adapted to guide the first floor panel relative to the second floor panel to increase a distance between the corresponding edges of the first floor panel and the second floor panel, wherein said hinge is reconfigurable by removal of a link of said hinge that prevents relative displacement of the second floor panel away from the first floor panel.

11. The reconfigurable floor according to claim 10, wherein the hinge includes a first linkage and a second linkage.

12. The reconfigurable floor according to claim 11, wherein the first linkage is removable from the second linkage.

13. The reconfigurable floor according to claim 12, wherein the first linkage, when attached to the second linkage, defines the axis about which the first floor panel rotates relative to the second floor panel from the folded position to the unfolded position.

14. The reconfigurable floor according to claim 12, wherein the first linkage, when attached to the second linkage, prevents the distance between corresponding edges of the first floor panel and the second floor panel from increasing in size.

15. The reconfigurable floor according to claim 14, wherein the second linkage comprises a pair of links that pivot relative to one another as the distance between corresponding edges of the first floor panel and the second floor panel increase in size.

16. The reconfigurable floor according to claim 10, wherein the hinge is removable from the first floor panel and the second floor panel.

* * * * *

UNITED STATES PATENT AND TRADEMARK OFFICE

CERTIFICATE OF CORRECTION

PATENT NO. : 7,631,460 B2
APPLICATION NO. : 10/515790
DATED : December 15, 2009
INVENTOR(S) : Donald Stewart Napier It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 695 days.

Signed and Sealed this

Second Day of November, 2010

David J. Kappos

David J. Kappos
*Director of the United States Patent and Trademark Office*